US008482585B2

(12) United States Patent
Ishii et al.

(10) Patent No.: US 8,482,585 B2
(45) Date of Patent: Jul. 9, 2013

(54) PRINTER AND MEDIUM

(75) Inventors: Hiroyasu Ishii, Shizuoka (JP); Kiyoshi Morino, Shizuoka (JP); Sadayoshi Mochida, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 94 days.

(21) Appl. No.: 13/270,318

(22) Filed: Oct. 11, 2011

(65) Prior Publication Data

US 2012/0105564 A1 May 3, 2012

(30) Foreign Application Priority Data

Oct. 29, 2010 (JP) ..... 2010-244493

(51) Int. Cl.
*B41J 33/00* (2006.01)

(52) U.S. Cl.
USPC ..... 347/172

(58) Field of Classification Search
USPC ..... 347/171, 172, 191, 194–195, 100, 347/98, 96, 95
See application file for complete search history.

(56) References Cited

U.S. PATENT DOCUMENTS

| | | | | |
|---|---|---|---|---|
| 5,175,563 | A * | 12/1992 | Fushimoto et al. | 347/172 |
| 5,486,857 | A * | 1/1996 | Smith et al. | 347/171 |
| 6,394,572 | B1 * | 5/2002 | Pierce et al. | 347/194 |
| 7,446,788 | B2 * | 11/2008 | Hart | 347/195 |
| 2004/0104991 | A1 * | 6/2004 | Hart | 347/191 |

FOREIGN PATENT DOCUMENTS

| | | |
|---|---|---|
| JP | 07-256965 | 10/1995 |
| JP | 11-248549 | 9/1999 |

OTHER PUBLICATIONS

Japanese Office Action of Notification of Reasons for Refusal Application No. 2010-244493 Dated Sep. 25, 2012, 6 pgs.

* cited by examiner

*Primary Examiner* — K. Feggins
(74) *Attorney, Agent, or Firm* — Turocy & Watson, LLP

(57) ABSTRACT

According to one embodiment, a printer includes a conveying mechanism, a first image forming unit, and a second image forming unit. The conveying mechanism conveys a medium. The first image forming unit forms an image with a non-temperature-sensitive ink whose color is not changed depending on a temperature, on the medium. The second image forming unit forms an image with a temperature-sensitive ink whose color is changed depending on a temperature, on the medium having the image with the non-temperature-sensitive ink formed thereon.

10 Claims, 11 Drawing Sheets

PRINTER AND MEDIUM

CROSS-REFERENCE TO RELATED APPLICATION

This application is based upon and claims the benefit of priority from Japanese Patent Application No. 2010-244493, filed on Oct. 29, 2010, the entire contents of which are incorporated herein by reference.

FIELD

Embodiments described herein relate generally to a printer and a printing method.

BACKGROUND

There is conventionally known a printer including a plurality of print heads as image forming units for forming images on a medium. In the printer of this type, the image forming units can form different ink images on the medium. As an example of inks, there is known a temperature-sensitive ink that changes color depending on the temperature thereof.

In the printer referred to above, it is desirable to efficiently visualize images when forming images with a temperature-sensitive ink and images with a non-temperature-sensitive ink on the medium.

DETAILED DESCRIPTION

Figure 1:
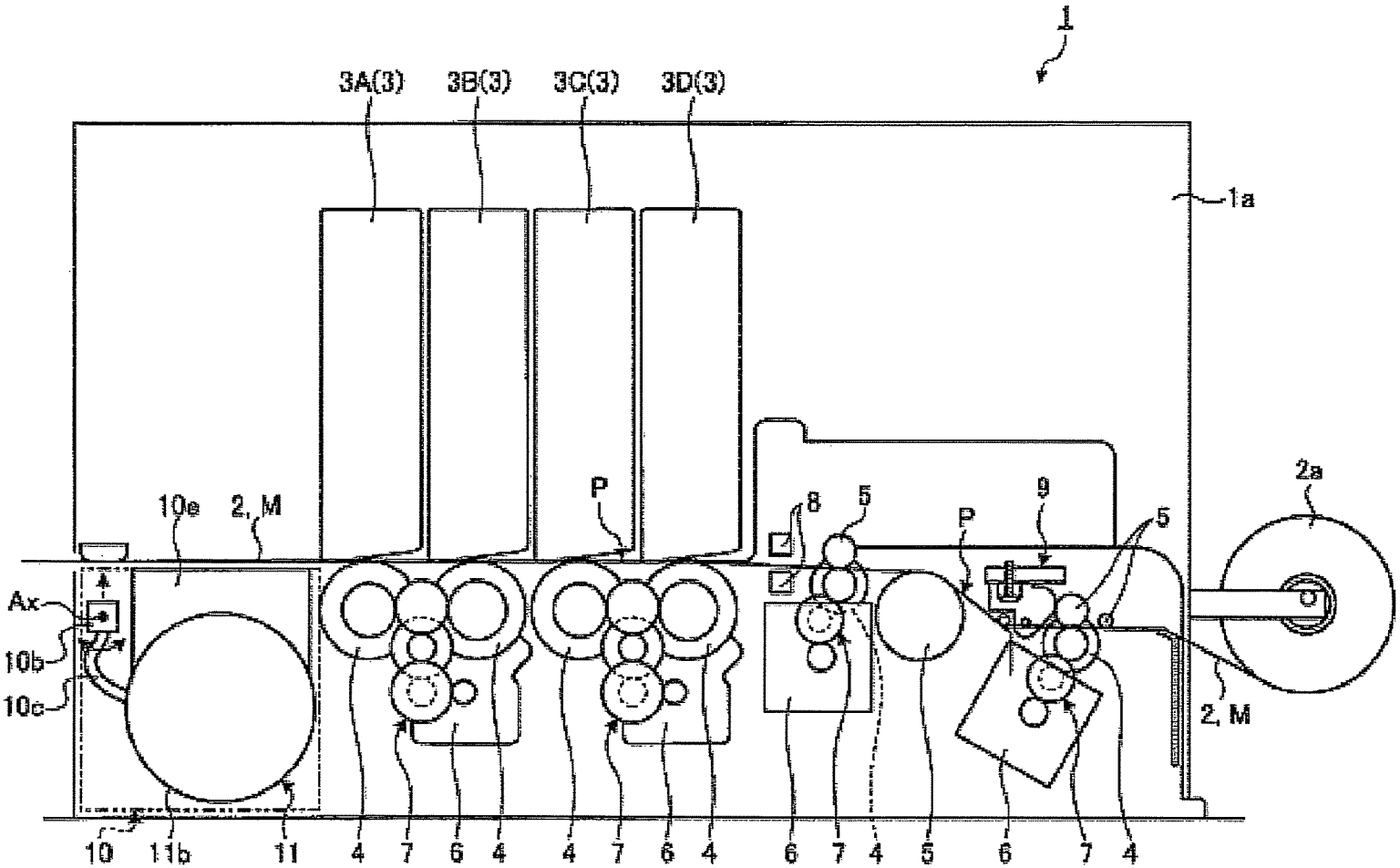
FIG. 1 is a side view showing a schematic configuration of a printer according to a first embodiment.

According to one embodiment, a printer includes a conveying mechanism, a first image forming unit, and a second image forming unit. The conveying mechanism conveys a medium. The first image forming unit forms an image with a non-temperature-sensitive ink whose color is not changed depending on a temperature, on the medium. The second image forming unit forms an image with a temperature-sensitive ink whose color is changed depending on a temperature, on the medium having the image with the non-temperature-sensitive ink formed thereon.

Certain embodiments will now be described in detail with reference to the drawings. The embodiments described below include like components. In the following description, like components will be designated by common reference symbols and will not be described repeatedly.

In a first embodiment, a printer 1 is made up of, e.g., a thermal printer configured to heat an ink ribbon and transfer an ink to a medium M such as a paper. The medium M may be, e.g., a label like the one shown in FIG. 8. A plurality of media M is attached to a surface of a strip-shaped backing paper 2 at a specified interval (pitch). Notches may be formed on the backing paper 2 so that the media M can be cut away from the backing paper 2.

The printer 1 includes a body unit la to which a plurality of (four, in the present embodiment) ink ribbon cartridges 3 (3A through 3D) can be attached in a removable manner. The ink ribbon cartridges 3 are arranged side by side along a conveyance path P of the strip-shaped backing paper 2 defined inside the printer 1. Each of the ink ribbon cartridges 3 includes a head (thermal head) 3*a* and an ink ribbon 3*d* (see FIGS. 9A and 9B). By causing the head 3*a* to heat the ink of the ink ribbon 3*d*, each of the ink ribbon cartridges 3 forms ink images (not shown in FIG. 1) on the medium M conveyed along the conveyance path P. In other words, the head (thermal head) 3*a* of each of the ink ribbon cartridges 3 corresponds to an image forming unit. The number of the ink ribbon cartridges 3 is not limited to four but may be set differently.

A roll 2*a* of the backing paper 2 is removably and rotatably mounted to the body unit 1*a* at the most upstream side of the conveyance path P. Upon rotation of conveying rollers 4, the backing paper 2 is drawn away from the roll 2*a* and conveyed through the conveyance path P.

The conveyance path P is defined not only by the arrangement of the ink ribbon cartridges 3 but also by the arrangement of the conveying rollers 4 and auxiliary rollers 5. The printer 1 includes a plurality of conveying rollers 4 rotationally driven by a motor 6. Rotation of the motor 6 is transmitted to the respective conveying rollers 4 through a rotation-transmitting mechanism (or a speed-reducing mechanism) 7. The printer 1 includes auxiliary rollers 5 arranged in such positions that the auxiliary rollers 5 pinch the backing paper 2 in cooperation with the conveying rollers 4 or in such positions that the backing paper 2 is stretched between the conveying rollers 4 or between the auxiliary rollers 5. The printer 1 further includes a sensor 8 for detecting the medium M and a tension detecting mechanism 9 for detecting the tension of the backing paper 2. In the present embodiment, the motor 6, the rotation-transmitting mechanism 7, the conveying rollers 4 and the auxiliary rollers 5 make up a conveying mechanism for conveying the backing paper 2 (the medium M).

The printer 1 can be mounted with an ink ribbon cartridge 3 having an ink ribbon of a non-temperature-sensitive ink whose color is not changed depending on a temperature. In addition, the printer 1 can be mounted with an ink ribbon cartridge 3 having an ink ribbon of a temperature-sensitive ink whose color is changed depending on a temperature. Moreover, the printer 1 can be mounted with an ink ribbon cartridge 3 having a differently-colored ink ribbon (with a non-temperature-sensitive ink or a temperature-sensitive ink). Each of the ink ribbon cartridges 3 can be removably mounted in one of the mounting positions of the ink ribbon cartridges 3 (3A through 3D) provided in the body unit 1*a*.

Figure 2A:
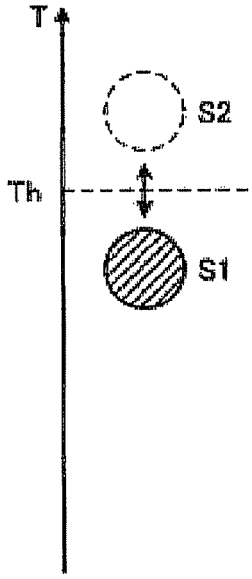
FIGS. 2A and 2B are explanatory views illustrating one example of the temperature-sensitive properties of a temperature-sensitive ink, FIG. 2A depicting the discoloring property of a temperature-sensitive ink having one threshold temperature and FIG. 2B depicting the discoloring property of a temperature-sensitive ink having two threshold temperatures.

Among the temperature-sensitive inks is an ink whose coloring state varies above and below a threshold temperature Th as depicted in FIG. 2A. For example, the temperature-sensitive ink depicted in FIG. 2A becomes white (S2) if the temperature T exceeds the threshold temperature Th but is colored (S1) if the temperature T is equal to or lower than the threshold temperature Th. If the medium M is a white color and the temperature-sensitive ink remains white (S2), the temperature-sensitive ink images formed on the medium M are hard to see or invisible. The temperature-dependent change of the coloring state of the temperature-sensitive ink is reversible.

Figure 2B:
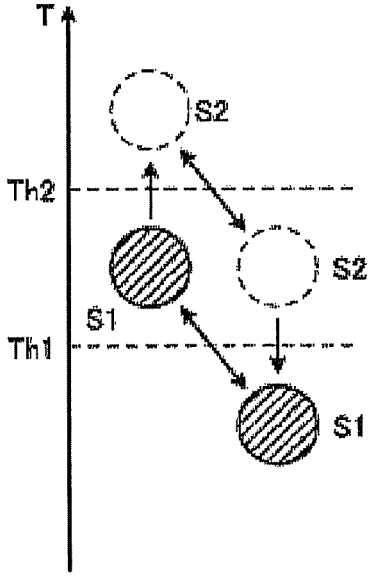

Among the temperature-sensitive inks, there is also an ink whose coloring state varies above and below two different threshold temperatures Th1 and Th2 when the temperature T goes up and down as depicted in FIG. 2B. For example, the temperature-sensitive ink depicted in FIG. 2B remains white (S2) if the temperature T, when going down, is higher than a first threshold temperature Th1 but is colored (S1) if the temperature T, when going down, becomes equal to or lower than the first threshold temperature Th1. If the medium M is a white color and the temperature-sensitive ink remains white (S2), the temperature-sensitive ink images formed on the medium M are hard to see or invisible. The temperature-sensitive ink depicted in FIG. 2B remains colored (S1) if the temperature T, when going up, is equal to or lower than a second threshold temperature Th2 but becomes white (S2) if the temperature T, when going up, grows higher than the second threshold temperature Th2. In this regard, the second threshold temperature Th2 is higher than the first threshold temperature Th1 as can be seen in FIG. 2B. Therefore, as long as the temperature T remains between the first threshold temperature Th1 and the second threshold temperature Th2, the coloring state of the temperature-sensitive ink in the falling process of the temperature T (i.e., changing from a temperature T exceeding the second threshold temperature Th2 to a temperature T equal to or lower than the second threshold temperature Th2) differs from the coloring state of the temperature-sensitive ink in the rising process of the temperature T (i.e., changing from a temperature T equal to or lower than the first threshold temperature Th1 to a temperature T greater than the first threshold temperature Th1). Since many different kinds of temperature-sensitive inks are available, it is possible to appropriately change the threshold temperatures Th, Th1 and Th2 and the coloring states.

In the case of a thermal printer, the temperature T goes up during an image forming process (heat transfer process). Therefore, if images with a temperature-sensitive ink whose color is changed to the same color as the medium M at a temperature higher that the threshold temperatures Th, Th1 and Th2 mentioned above are formed on the medium M through the use of the printer 1, it is often impossible or difficult to determine whether the temperature-sensitive ink images are successfully formed on the medium M. Depending on the kinds of temperature-sensitive inks, it is sometimes the case that the temperature-sensitive ink images formed on the medium M are hardly visible at a normal temperature. In view of this, the printer 1 of the present embodiment includes a cooling mechanism 10 that serves as a coloring conversion mechanism for converting the coloring state of temperature-sensitive ink images formed on the medium M. In the present embodiment, the temperature T is reduced by, e.g., cooling the temperature-sensitive ink images with the cooling mechanism 10. Thus, the temperature-sensitive ink images get visualized and become readily visible, thereby making it easy to check the formation situation of the temperature-sensitive ink images on the medium M. In other words, the cooling mechanism 10 may be said to be a coloring conversion mechanism or a visualizing mechanism of temperature-sensitive ink images. In the present embodiment, a cooling mechanism provided in the printer 1 may be a feature different from generally available commercial printers, since a cooling mechanism is not usually provided in a general printer. That is, it has not been tried to provide a cooling mechanism in a thermal printer that is used to perform printing in a state of high temperature.

In the present embodiment, the cooling mechanism 10 is configured to spout, e.g., a gas, and reduce the temperature of the medium M, namely the temperature of the temperature-sensitive ink images, using the adiabatic expansion or the latent heat of the gas. More specifically, the cooling mechanism 10 includes a mounting portion 10*a* for holding a gas cartridge 11 of a gas cylinder, a spouting portion 10*b*, a tube 10*c*, a valve 10*d* and a cooling fin 10*e*.

The gas cartridge 11 is removably mounted to the mounting portion 10*a*. The mounting portion 10*a* serves as a connector for receiving a connector 11*a* of the gas cartridge 11. The mounting portion 10*a* may include a movable lever (not shown) used in removing the gas cartridge 11 and a lock mechanism (not shown) for fixing the gas cartridge 11 in a mounting position.

The gas cartridge 11 may be made up of, e.g., a gas cylinder (gas bomb) filled with a liquefied gas. As the gas (coolant), it is possible to use, e.g., tetrafluoroethane.

Figure 3:
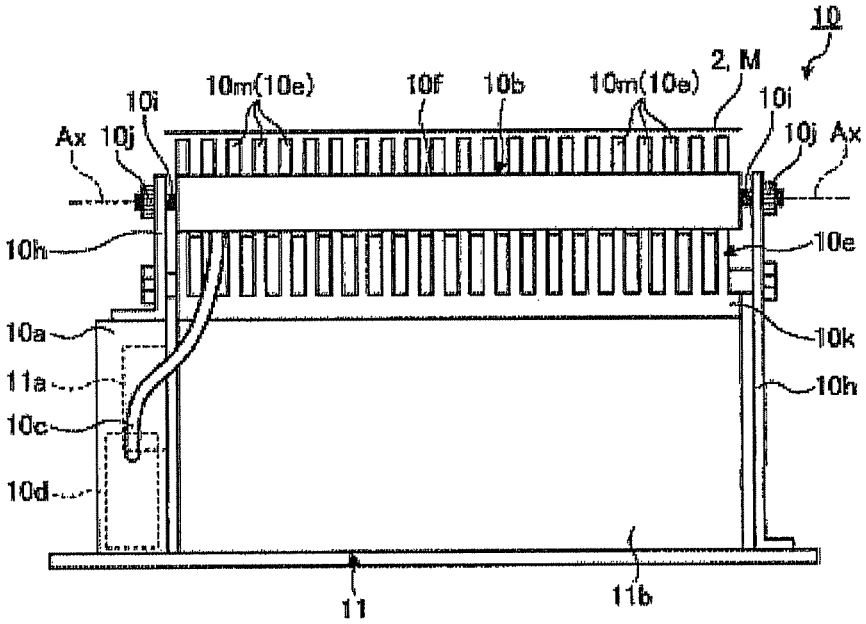
FIG. 3 is a front view showing a cooling mechanism included in the printer.
Figure 5:
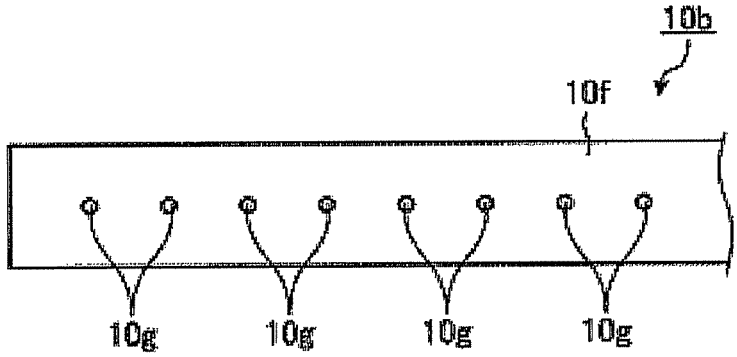
FIG. 5 is a plan view of a portion of the spouting portion of the cooling mechanism shown in FIG. 3, when seen from a front surface of a backing paper.

As shown in FIGS. 1 and 3, the spouting portion 10*b* is arranged to extend in the width direction of the backing paper 2 along the rear surface of the backing paper 2. The spouting portion 10*b* is a gas pipe having a gas flow path formed therein. Referring to FIG. 5, the spouting portion 10*b* has an upper wall 10*f* and a plurality of nozzle holes 10*g* formed side by side in the upper wall 10*f* at a regular interval (pitch). The gas is spouted from the nozzle holes 10*g* toward the rear surface of the backing paper 2. The nozzle holes 10*g* may be arranged in plural rows.

Figure 4A:
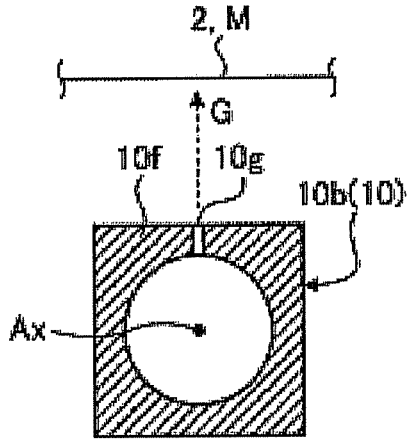
FIGS. 4A and 4B are section views showing a spouting portion included in the cooling mechanism shown in FIG. 3, FIG. 4A illustrating a state in which a gas is spouted at a right angle with respect to a medium and FIG. 4B illustrating a state in which the gas is obliquely spouted with respect to the medium.
Figure 4B:
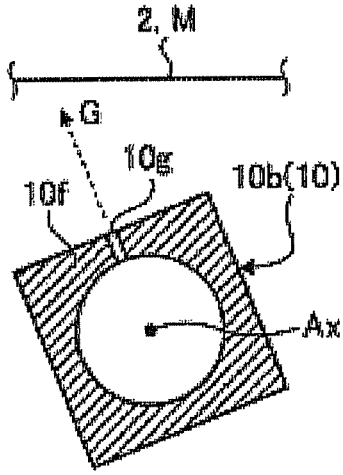

The spouting portion 10*b* is supported by brackets 10*h* to rotate about a rotation axis Ax extending in the width direction of the backing paper 2 and is capable of changing the spouting angle (spouting direction) of the gas G as illustrated in FIGS. 4A and 4B. More specifically, as shown in FIG. 3, the spouting portion 10*b* can be fixed at an arbitrary angle by arranging the spouting portion 10*b* at a specified spouting angle and then tightening nuts 10*j* to the male screw portions 10*i* of the spouting portion 10*b* inserted into the through-holes (not shown) of the brackets 10*h*. The cooling degree of the backing paper 2 cooled by the gas G can be variably set by variably setting the spouting angle. For instance, cooling is more heavily performed in the arrangement shown in FIG. 4A than in the arrangement shown in FIG. 4B. Thus, the temperature-sensitive ink images formed on the medium M have a lower temperature in the arrangement shown in FIG. 4A than in the arrangement shown in FIG. 4B. In the present embodiment, the spouting portion 10*b* includes a spouting condition adjusting mechanism as set forth above.

The tube 10*c* has pressure resistance and flexibility required for the tube 10*c* to serve as a gas conduit between the mounting portion 10*a* and the spouting portion 10*b* regardless of the change of the angle of the spouting portion 10*b*.

The valve 10*d* can switch the spouting of the gas from the spouting portion 10*b* and the blocking of the gas by opening or closing a gas flow path extending from the gas cartridge 11 to the spouting portion 10. The valve 10*d* may be made up of, e.g., a solenoid valve which is opened in response to an electric signal supplied from a CPU 20*a* (see FIG. 6). The valve 10*d* can be attached to the mounting portion 10*a*. The spouting condition of the gas can be variably set by controlling the opening and closing of the valve 10*d* (e.g., the length of opening time, the number of repetition of opening and closing, and the period of repetition of opening and closing).

The cooling fin 10*e* includes a base portion 10*k* close to or adjoining the outer circumferential surface 11*b* of the gas cartridge 11 and a plurality of plate-shaped portions 10*m* extending in the conveying direction and protruding from the base portion 10*k* toward positions near the rear surface of the backing paper 2. When the temperature of the gas cartridge 11 is reduced by spouting the gas, the cooling fin 10*e* can enhance the cooling performance for the medium M. The cooling mechanism 10 can be removably mounted to the body unit 1*a*.

Figure 6:
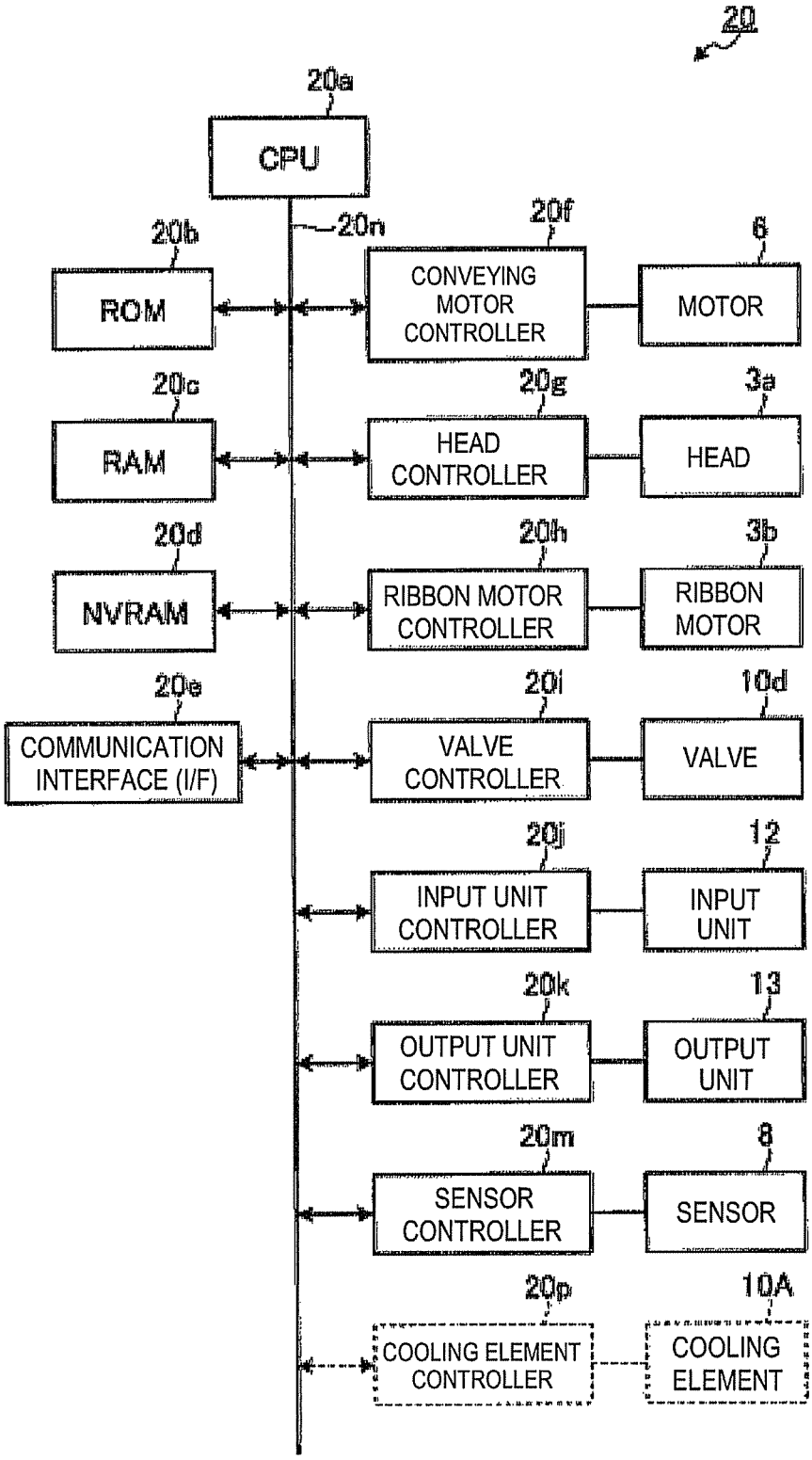
FIG. 6 is a block diagram showing one example of a control circuit included in the printer.

Referring to FIG. 6, the control circuit 20 of the printer 1 includes a CPU (Central Processing Unit) 20*a* as a control unit, a ROM (Read Only Memory) 20*b*, a RAM (Random Access Memory) 20*c*, an NVRAM (Non-Volatile Random Access Memory) 20*d*, a communication interface (I/F) 20*e*, a conveying motor controller 20*f*, a head controller 20*g*, a ribbon motor controller 20*h*, a valve controller 20*i*, an input unit controller 20*j*, an output unit controller 20*k* and a sensor controller 20*m*, all of which are connected to one another through a bus 20*n* such as an address bus or a data bus.

The CPU 20*a* controls each unit of the printer 1 by executing various kinds of computer-readable programs stored in the ROM 20*b* or other places. The ROM 20*b* stores, e.g., various kinds of data processed by the CPU 20*a* and various kinds of programs (such as a basic input/output system abbreviated as BIOS, an application program and a device driver program) executed by the CPU 20*a*. The RAM 20*c* temporarily stores data and programs while the CPU 20*a* executes various kinds of programs. The NVRAM 20*d* stores, e.g., an OS (Operating System), an application program, a device driver program and various kinds of data which are to be kept intact even when the power is turned off.

The communication interface (I/F) 20*e* controls data communication with other devices connected through telecommunication lines.

The conveying motor controller 20*f* controls the motor 6 pursuant to an instruction supplied from the CPU 20*a*. The head controller 20*g* controls the head 3*a* (see FIG. 9) in response to an instruction supplied from the CPU 20*a*. The ribbon motor controller 20*h* controls a ribbon motor 3*b* built in each of the ink ribbon cartridges 3 according to an instruction supplied from the CPU 20*a*. The valve controller 20*i* controls the valve 10*d* (the solenoid of the valve 10*d*) of the cooling mechanism 10 based on an instruction supplied from the CPU 20*a*.

The input unit controller 20*j* transmits to the CPU 20*a* signals inputted through an input unit 12 (e.g., push buttons, a touch panel, a keyboard, a microphone, knobs or DIP switches) for inputting manual operations or voices of a user. The output unit controller 20*k* controls an output unit 13 (e.g., a display, a light-emitting unit, a speaker or a buzzer) for outputting images or voices pursuant to an instruction supplied from the CPU 20*a*. The sensor controller 20*m* transmits to the CPU 20*a* a signal indicative of the detection result of a sensor 8.

Figure 7:
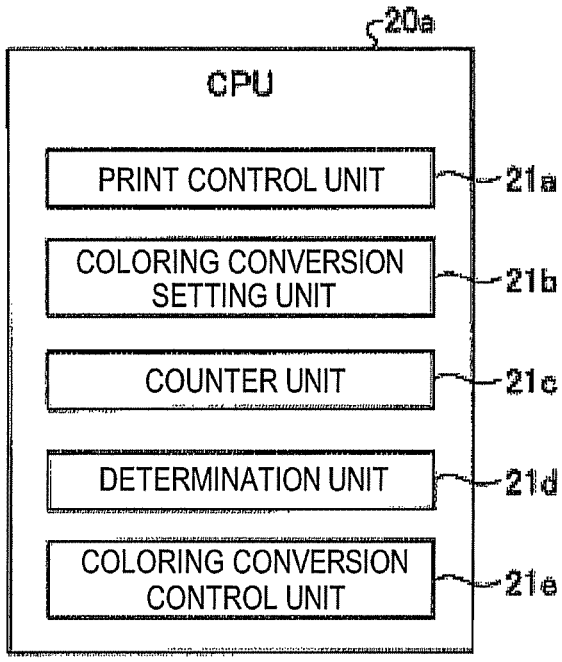
FIG. 7 is a block diagram showing one example of a CPU included in the printer.

Turning to FIG. 7, the CPU 20*a* as a control unit 2 works as a print control unit 21*a*, a coloring conversion setting unit 21*b*, a counter unit 21*c*, a determination unit 21*d* and a coloring conversion control unit 21*e* according to the programs executed. The programs contain modules corresponding to at least the print control unit 21*a*, the coloring conversion setting unit 21*b*, the counter unit 21*c*, the determination unit 21*d* and the coloring conversion control unit 21*e*.

The print control unit 21*a* controls the motor 6, the head 3*a* and the ribbon motor 3*b* through the conveying motor controller 20*f*, the head controller 20*g* and the ribbon motor controller 20*h*. Images such as letters or pictures are formed on the medium M under the control of the print control unit 21*a*.

The coloring conversion setting unit 21*b* performs various kinds of setting operations associated with the coloring conversion of the temperature-sensitive ink images printed on the medium M (the cooling performed by the cooling mechanism 10 in the present embodiment). More specifically, the coloring conversion setting unit 21*b* can cause the storage unit such as the NVRAM 20*d* to store a pitch (frequency) at which coloring conversion (cooling) is performed with respect to the medium M and a parameter for setting the opening or closing conditions of the valve 10*d* (e.g., the opening/closing timing, the opening/closing duration, the number of opening/closing times and the opening/closing time period), which are inputted through the input unit 12.

The counter unit 21*c* counts the number of the media M (or the number of image formation areas) detected by the sensor 8. The determination unit 21*d* compares the count value counted by the counter unit 21*c* with the pitch (frequency) stored in the storage unit and determines whether to perform coloring conversion (cooling in the present embodiment). The coloring conversion control unit 21*e* controls each part or unit (the respective parts of the cooling mechanism 10 in the present embodiment) in order to perform coloring conversion (cooling in the present embodiment) with respect to the medium M (the temperature-sensitive ink images formed on the medium M) that is determined to be subjected to coloring conversion. In the present embodiment, the coloring conversion control unit 21*e* performs the coloring conversion of the medium M by controlling the opening/closing state of the valve 10*d* and consequently controlling the spouting state of the gas. The coloring conversion control unit 21*e* also corresponds to the spouting condition adjusting mechanism. In the present embodiment, pursuant to the setting of the pitch (frequency), the coloring conversion can be performed with respect to the temperature-sensitive ink images formed on all the media M or some of the media M.

Figure 8A:
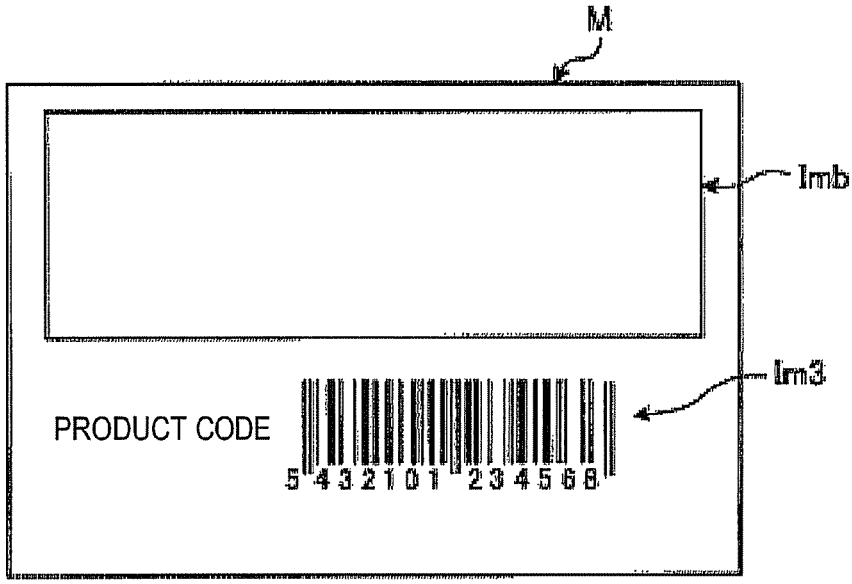
FIGS. 8A and 8B are views showing one example of a product label as a medium obtained in the printer, FIG. 8A illustrating a state in which images with a temperature-sensitive ink are hard to see (invisible) and FIG. 8B illustrating a state in which images with a temperature-sensitive ink are easy to see (visible).
Figure 8B:
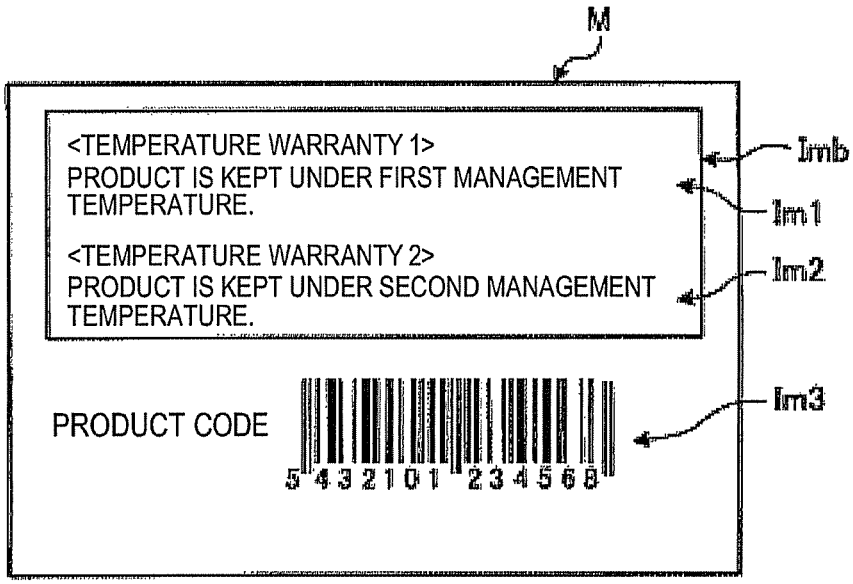

The printer 1 configured as above can produce, e.g., a medium M as illustrated in FIG. 8A or 8B. FIG. 8A illustrates a product label as a medium M outputted from the printer 1 with no cooling performed by the cooling mechanism 10. FIG. 8B illustrates a product label as a medium M outputted from the printer 1 with the cooling performed by the cooling mechanism 10. The temperature-sensitive ink images Im1 and Im2 are visualized when the cooling is performed by the cooling mechanism 10. Accordingly, a user or an operator of the printer 1 is easily able to visually recognize the formation of the temperature-sensitive ink images Im1 and Im2 on the medium M. FIGS. 8A and 8B illustrate a case where images Im1 and Im2 of two kinds of temperature-sensitive inks differing in threshold temperature Th are formed on the medium M. Moreover, an image Im3 (e.g., a barcode) formed by a typical ink whose coloring state is not changed by the temperature is also formed on the medium M.

The temperature-sensitive ink images Im1 and Im2 illustrated in FIG. 8B are formed over a non-temperature-sensitive ink image Imb. Use of the non-temperature-sensitive ink image Imb as a background makes it possible to further distinguish the colors of the temperature-sensitive ink images Im1 and Im2 than in a case where the medium M is used as a background. The color of the non-temperature-sensitive ink image Imb and the colors of the temperature-sensitive ink images Im1 and Im2 may be set in many different combinations. For example, it may be possible to set a combination of mutually complementary colors or a combination of different brightness or different saturation.

If the temperature-sensitive ink images Im1 and Im2 have the property of transmitting visible rays, the images Im1 and Im2 can be visualized with a color obtained by mixing the colors of the temperature-sensitive ink images Im1 and Im2 and the color of the non-temperature-sensitive ink image Imb.

When the temperature-sensitive ink images Im1 and Im2 are formed by two kinds of temperature-sensitive inks differing in the threshold temperatures Th1 and Th2 as set forth above, the ink ribbon cartridges 3 for forming the temperature-sensitive ink images Im1 and Im2 are independently mounted to the body unit 1*a* because the inks used differ from each other.

In order for the printer 1 to form the temperature-sensitive ink images Im1 and Im2 on the medium M having the non-temperature-sensitive ink image Imb formed thereon, the ink ribbon cartridge 3 (e.g., the ink ribbon cartridge 3D) for forming the non-temperature-sensitive ink image Imb is arranged at the upstream side of the conveyance path P and the ink ribbon cartridges 3 (e.g., the ink ribbon cartridges 3A and 3B) for forming the temperature-sensitive ink images Im1 and Im2 are arranged at the downstream side of the conveyance path P. The ink ribbon cartridge 3 (e.g., the ink ribbon cartridge 3C) for forming the non-temperature-sensitive ink image Im3 may be arranged between the ink ribbon cartridge 3 for forming the non-temperature-sensitive ink image Imb and the ink ribbon cartridges 3 for forming the temperature-sensitive ink images Im1 and Im2. In this example, the heads 3*a* (see FIGS. 9A and 9B) of the ink ribbon cartridges 3A and 3B correspond to a second image forming unit.

As one example, the medium M illustrated in FIGS. 8A and 8B can be used for temperature management in refrigerating or freezing a product. More specifically, the medium M on which the images Im1 and Im2 of the temperature-sensitive ink having the temperature-sensitive property depicted in FIG. 2A formed by the printer 1 is used as a product label. The printer 1 utilizes a temperature-sensitive ink having a threshold temperature Th as a management temperature (e.g., 5 degrees Celsius) that a product to be refrigerated or frozen is not allowed to exceed. As a result, if a product temperature exceeds the threshold temperature Th, the medium M comes into the state as illustrated in FIG. 8A. Thus, the temperature-sensitive ink images Im1 and Im2 become hard to see or invisible (S2 in FIG. 2A). On the other hand, if the product temperature is equal to or lower than the threshold temperature Th as the management temperature, the medium M is kept in the state illustrated in FIG. 8B (S1 in FIG. 2A). This enables a worker or other persons to determine whether the product temperature is higher than or lower than the management temperature, based on whether the temperature-sensitive ink images Im1 and Im2 are easy to see (visible) or hard to see (invisible). In the example illustrated in FIGS. 8A and 8B, the images Im1 and Im2 of two kinds of temperature-sensitive inks differing in the threshold temperature Th are formed on the medium M to thereby indicate the product management results in respect of two kinds of management temperatures (first and second management temperatures). In this example, the formation condition of the temperature-sensitive ink images Im1 and Im2 on the medium M can be visually confirmed by cooling the medium M with the cooling mechanism 10.

As another example, images Im1 and Im2 of a temperature-sensitive ink with a temperature-sensitive property showing a hysteresis in temperature rising and falling processes as depicted in FIG. 2B can be formed by the printer 1 on a product label as a medium M illustrated in FIGS. 8A and 8B. In this case, the printer 1 forms the images Im1 and Im2 on the medium M through the use of a temperature-sensitive ink having a threshold temperature Th2 as a management temperature (e.g., −5 degrees Celsius) that a product to be refrigerated or frozen is not allowed to exceed and a threshold temperature Th1 as a temperature (e.g., −30 degrees Celsius) that cannot be realized in a specified refrigerating or freezing state. In the printer 1, the cooling mechanism 10 cools the images Im1 and Im2 to the threshold temperature Th1 or lower (e.g., −40 degrees Celsius) so that the images Im1 and Im2 formed by the printer 1 can be visualized on the medium M. In the case of this example, all of the media M are cooled by the cooling mechanism 10 to first reduce the temperature of the media M to the threshold temperature Th1 or lower. As a result, if a product temperature exceeds the threshold temperature'Th2 as the management temperature even for a single time, the medium M comes into the state illustrated in FIG. 8A. Thus, the temperature-sensitive ink images Im1 and Im2 become hard to see or invisible (S2 in FIG. 2B) and continue to remain in this state (S2). On the other hand, if the product temperature is equal to or lower than the threshold temperature Th2 as the management temperature, the medium M is kept in the state illustrated in FIG. 8B (S1 in FIG. 2B). This enables a worker or other persons to determine whether the product temperature has ever exceeded the management temperature before, based on whether the temperature-sensitive ink images Im1 and Im2 are easy to see (visible) or hard to see (invisible). In this example, the images Im1 and Im2 of two kinds of temperature-sensitive inks differing in the threshold temperature Th2 are formed on the medium M to thereby indicate the product management results in respect of two kinds of management temperatures (first and second management temperatures).

Figure 9A:
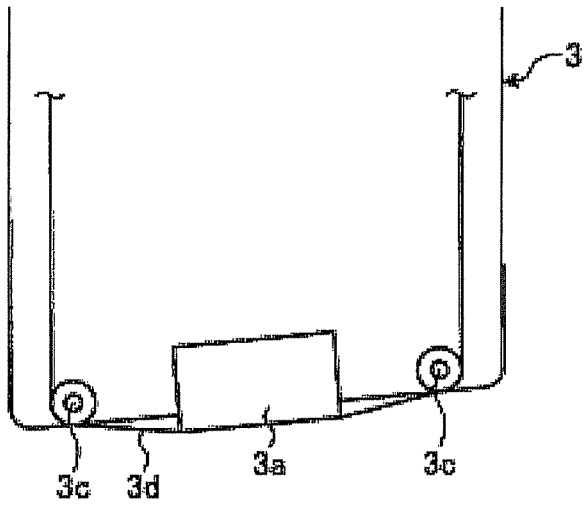
FIGS. 9A and 9B are side views schematically showing portions of ink ribbon cartridges included in the printer, FIG. 9A illustrating an ink ribbon cartridge having a long contact section over which an ink ribbon makes contact with a medium and FIG. 9B illustrating an ink ribbon cartridge having a short contact section over which an ink ribbon makes contact with a medium.
Figure 9B:
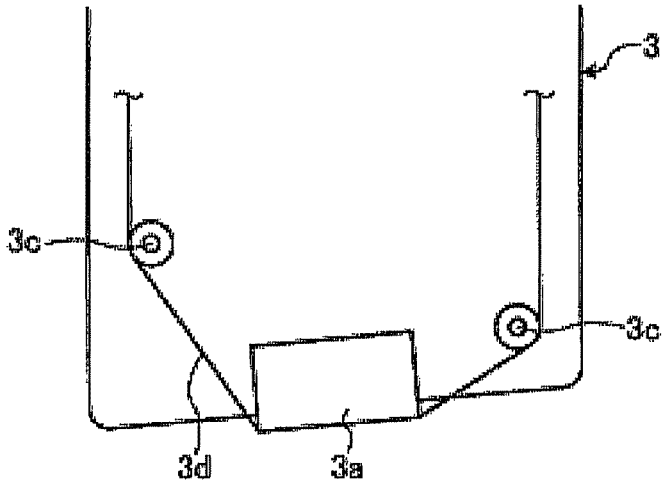

In the printer 1 of the present embodiment, as shown in FIGS. 9A and 9B, it is possible to use ink ribbon cartridges 3 that differ from each other in the positions of the ribbon rollers 3*c* with respect to the head 3*a*. In the configuration shown in FIG. 9A, the ink ribbon 3*d* and the medium M make contact with each other for a long period of time. In the configuration shown in FIG. 9B, the ink ribbon 3*d* and the medium M make contact with each other for a short period of time. One of these configurations can be selected depending on the properties of the temperature-sensitive ink or the non-temperature-sensitive ink. In the present embodiment, the ink ribbon cartridge 3 corresponds to an ink ribbon holding unit. The ribbon motor 3*b* and the ribbon rollers 3*c* make up a ribbon conveying unit.

In the printer 1 of the present embodiment described above, the head 3*a* of the ink ribbon cartridge 3 as an image forming unit forms temperature-sensitive ink images on the medium M and the cooling mechanism 10 as a coloring conversion mechanism converts the coloring of the images. According to the present embodiment, it is therefore possible to impart desired coloring states to the temperature-sensitive ink images formed on the medium M outputted from the printer 1. It is also easy to confirm whether desired temperature-sensitive ink images are successfully formed on the medium M.

In the present embodiment, the cooling mechanism 10 as a coloring conversion mechanism reduces the temperature of the images by spouting a gas. This makes it possible to obtain the cooling mechanism 10 with a relatively simple structure.

In the present embodiment, the printer 1 includes, as the spouting condition adjusting mechanism for adjusting the spouting condition of the gas, a mechanism for adjusting the posture of the spouting portion 10*b* (e.g., the spouting direction of the gas G spouted from the nozzle holes 10*g*) and a mechanism for variably setting the gas spouting timing or the gas spouting time period (e.g., the opening/closing time period of the valve 10*d*). This makes it possible to suitably adjust the condition of the cooling performed by the gas.

Figure 10:
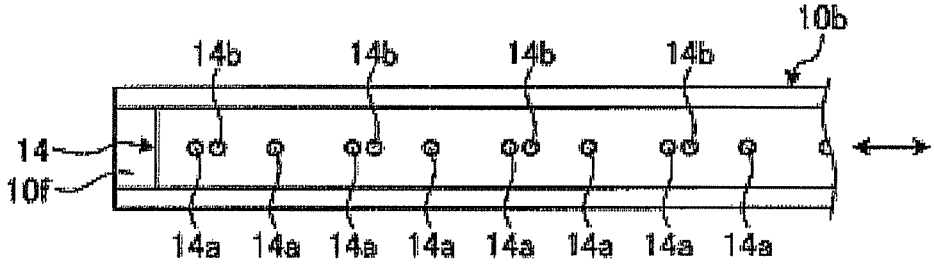
FIG. 10 is a plan view showing a movable plate included in a printer according to a modified example of the first embodiment.

As the spouting condition adjusting mechanism, it is possible to employ, e.g., a movable plate 14 for changing the number of effective nozzle holes 10*g* as shown in FIG. 10. The movable plate 14 is supported on the upper wall 10*f* of the spouting portion 10*b* to movably slide along the upper wall 10*f*. The movable plate 14 has through-holes 14*a* overlapping with all of the nozzle holes 10*g* when the movable plate 14 is in one position and through-holes 14*b* overlapping with some of the nozzle holes 10*g* when the movable plate 14 is in another position. By sliding the movable plate 14, it is possible to switch a state in which the gas is spouted from all of the nozzle holes 10*g* through the through-holes 14*a* and a state in which the gas is spouted from some of the nozzle holes 10*g* through the through-holes 14*b*. This makes it possible to variably set the amount of the spouting gas, thereby variably setting the cooling degree of the temperature-sensitive ink images.

In the present embodiment, the printer 1 includes the heads 3*a* of the ink ribbon cartridges 3 as a plurality of image forming units for forming images with different temperature-sensitive inks on the medium M. Accordingly, a plurality of ink images differing in temperature-sensitive property can be formed on the medium M, which makes it possible to perform temperature management in multiple stages.

In the present embodiment, the cooling mechanism 10 cools the temperature-sensitive ink image extracted (selected or designated) and converts the coloring state thereof. This configuration can reduce energy consumption as compared with a case where all the temperature-sensitive ink images are cooled.

Figure 11:
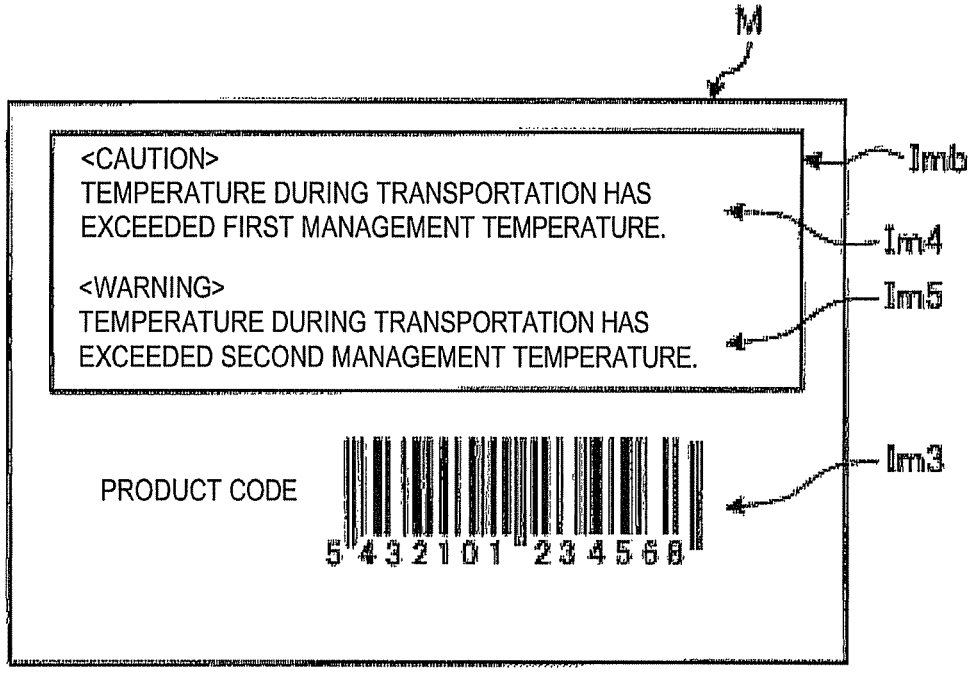
FIG. 11 is a view showing one example of a product label as a medium obtained in the printer according to the modified example of the first embodiment.

In the printer 1, it is also possible to use a temperature-sensitive ink having a property opposite to the property of the temperature-sensitive ink stated above, namely a temperature-sensitive ink having such property that the temperature-sensitive ink is visualized when the temperature thereof exceeds a management temperature. For example, as shown in FIG. 11, if the ink temperature is higher than the threshold temperature, a message of "caution" or "warning" indicating that the temperature of the temperature-sensitive ink image Im4 or Im5 has exceeded the management temperature appears on the medium M as a product label. In this example, images Im4 and Im5 of temperature-sensitive inks differing in the threshold temperature are formed on the medium M, which makes it possible to manage a product at different temperatures. In the printer 1 corresponding to the example shown in FIG. 11, a heating mechanism instead of the cooling mechanism 10 can be provided as the coloring conversion mechanism. In this example, it is equally possible to form the temperature-sensitive ink images Im4 and Im5 over a non-temperature-sensitive ink image Imb formed on the medium M. In this example, the temperature-sensitive ink images Im4 and Im5 are visualized to issue a caution notice or a warning notice when a specified temperature condition is not satisfied.

Figure 12:
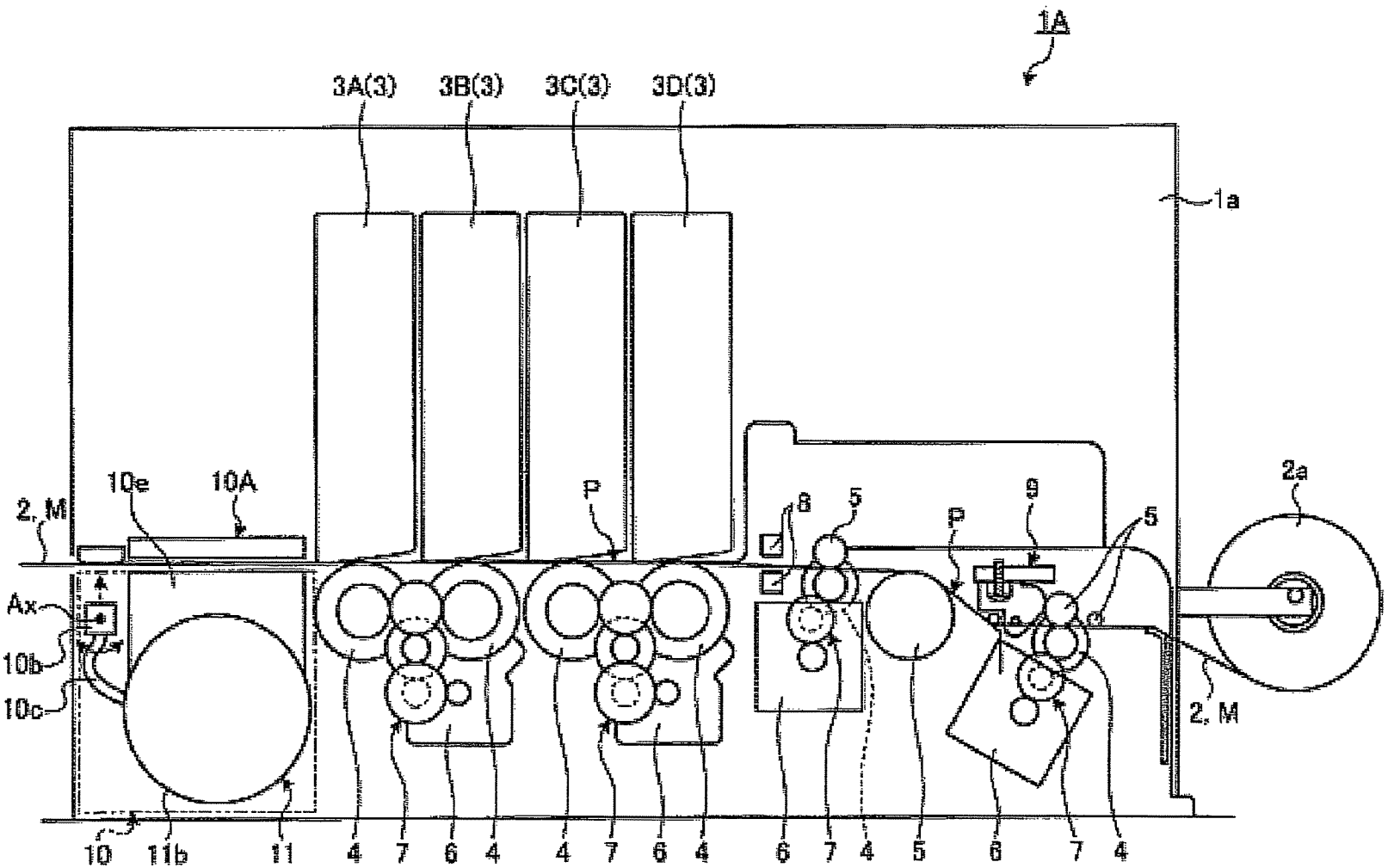
FIG. 12 is a side view showing a schematic configuration of a printer according to a second embodiment.

Referring to FIG. 12, the printer 1 of the second embodiment includes not only the cooling mechanism 10 but also a cooling element 10A as a second cooling mechanism. The cooling element 10A may be composed of, e.g., a Peltier element, and is controlled by a cooling element controller 20*p* as indicated by broken lines in FIG. 6. In this configuration, the cooling temperature of the medium M (the temperature-sensitive ink images) can be finely set by selectively using (one of) the cooling mechanism 10 and the cooling element 10A, using the cooling mechanism 10 and the cooling element 10A in combination or adjusting the cooling performance thereof. When images with different temperature-sensitive inks are formed on the medium M, the efficiency of the coloring conversion performed through a cooling operation can be increased by matching the cooling mechanism 10 and the cooling element 10A with the respective temperature-sensitive inks. The printer may include a plurality of cooling mechanisms of the same type. In the present embodiment, it is equally possible to form temperature-sensitive ink images over a non-temperature-sensitive ink image formed on the medium M.

Figure 13:
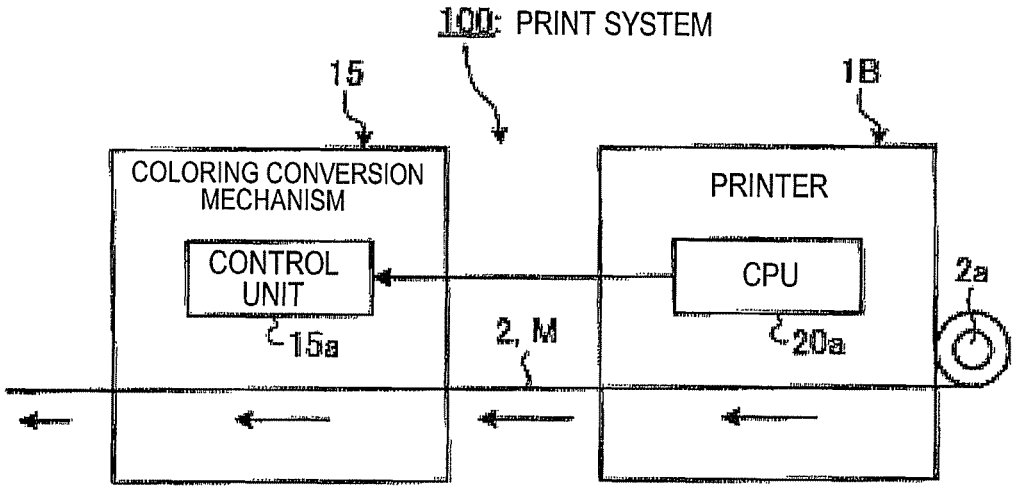
FIG. 13 is a view showing a schematic configuration of a print system according to a third embodiment.

Referring to FIG. 13, a print system 100 of the third embodiment includes a printer 1B and a coloring conversion mechanism 15 for converting the coloring states of temperature-sensitive ink images formed on a medium M by the printer 1B. The coloring conversion mechanism 15 includes one of a cooling mechanism and a heating mechanism. In the print system 100, the printer 1B and the coloring conversion mechanism 15 are not unified with each other but are arranged independently of each other. An electric signal is transmitted from a CPU 20*a* as a control unit of the printer 1B to a control unit 15*a* of the coloring conversion mechanism 15. Responsive to the electric signal, the coloring conversion mechanism 15 performs a coloring conversion process. The electric signal may be a signal indicating the execution of coloring conversion, a signal indicating the timing of execution of coloring conversion or a signal indicating an execution parameter of coloring conversion. In the present embodiment, it is equally possible to form temperature-sensitive ink images over a non-temperature-sensitive ink image formed on the medium M.

While certain preferred embodiments have been described above, the present disclosure is not limited thereto but may be modified in many different forms. For example, the printer may include three or more image forming units for forming images with different temperature-sensitive inks. The printer may include both the cooling mechanism and the heating mechanism as the coloring conversion mechanism. In this case, one of the cooling mechanism and the heating mechanism may be caused to act on the temperature-sensitive ink images to first bring the images into an easy-to-see (visible) state. Thereafter, the other may be caused to act on the temperature-sensitive ink images to bring the images into a hard-to-see (invisible) state (namely, to return the images to the original state). This enables a worker or other persons to confirm the temperature-sensitive ink images in the easy-to-see (visible) state. The number of the cooling mechanism and the heating mechanism may be changed to many other numbers. The temperature-sensitive ink images may be formed over a portion of the non-temperature-sensitive ink image.

The printer may include a spouting portion for spouting a cold gas or a hot gas as the cooling mechanism or the heating mechanism. A cold gas or a hot gas can be fed from the outside to the spouting portion through a connector and a pipe. In this configuration, it is possible to omit the gas cartridge, which makes it possible to reduce the size of the printer proportionate to the omission of the gas cartridge.

The printer may be configured from a printer of another type using ink (e.g., an inkjet printer). In case of an inkjet printer, an ink head corresponds to the image forming unit.

The specifications (type, structure, shape, size, arrangement, position, number, constituent or temperature-sensitive property) of the respective components (the print system, the printer, the medium, the ink ribbon cartridge, the image forming unit, the coloring conversion mechanism, the cooling mechanism, the heating mechanism, the spouting condition adjusting mechanism, the coloring conversion device, the image or the temperature-sensitive ink) may be appropriately modified and embodied.

As used in this application, entities for executing the actions can refer to a computer-related entity, either hardware, a combination of hardware and software, software, or software in execution. For example, an entity for executing an action can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and an entity can be localized on one apparatus and/or distributed between two or more apparatuses.

The program for realizing the functions can be recorded in the apparatus, can be downloaded through a network to the apparatus, or can be installed in the apparatus from a computer readable storage medium storing the program therein. A form of the computer readable storage medium can be any form as long as the computer readable storage medium can store programs and is readable by the apparatus such as a disk type ROM and a solid-state computer storage media. The functions obtained by installation or download in advance in this way can be realized in cooperation with an OS (Operating System) in the apparatus.

While certain embodiments have been described, these embodiments have been presented by way of example only, and are not intended to limit the scope of the inventions. Indeed, the novel printer and medium described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer, comprising:

a conveying mechanism configured to convey a medium;

a first image forming unit configured to form an image with a non-temperature-sensitive ink whose color is not changed depending on a temperature, on the medium; and a second image forming unit configured to form an image with a temperature-sensitive ink whose color is changed depending on a temperature, on the medium having the image with the non-temperature-sensitive ink formed thereon.

2. The printer of claim 1, wherein the second image forming unit is configured to form the image with the temperature-sensitive ink in such a state as to cover at least a portion of the image with the non-temperature-sensitive ink.

3. The printer of claim 2, wherein the image with the temperature-sensitive ink has a property of transmitting visible rays.

4. The printer of claim 1, wherein the second image forming unit is configured to form, as the image with the temperature-sensitive ink, an image which is visualized when a specified temperature condition is not satisfied.

5. The printer of claim 1, further comprising:

a coloring conversion mechanism configured to convert a coloring state of the image with the temperature-sensitive ink by heating or cooling the image with the temperature-sensitive ink.

6. A printer, comprising:

a first ink ribbon holding unit configured to hold an ink ribbon applied with a non-temperature-sensitive ink whose color is not changed depending on a temperature;

a first conveying unit configured to convey the ink ribbon held by the first ink ribbon holding unit;

a first thermal head configured to heat the non-temperature-sensitive ink and form an image with the non-temperature-sensitive ink on a medium;

a second ink ribbon holding unit configured to hold an ink ribbon applied with a temperature-sensitive ink whose color is changed depending on a temperature;

a second conveying unit configured to convey the ink ribbon held by the second ink ribbon holding unit; and a second thermal head configured to heat the temperature-sensitive ink and form an image with the temperature-sensitive ink on the medium having the image with the non-temperature-sensitive ink formed thereon.

7. A printing method, comprising:

conveying a medium through a conveyance path by a conveying mechanism;

forming an image with a non-temperature sensitive ink whose color is not changed depending on a temperature, on the medium; and forming an image with a temperature-sensitive ink whose color is changed depending on a temperature, on the medium having the image with the non-temperature-sensitive ink formed thereon.

8. The method of claim 7, wherein the image with the temperature-sensitive ink is formed in such a state as to cover at least a portion of the image with the non-temperature-sensitive ink.

9. The method of claim 7, wherein the image with the temperature-sensitive ink is formed to be visualized when a specified temperature condition is not satisfied.

10. The method of claim 7, further comprising:

converting a coloring state of the image with the temperature-sensitive ink by heating or cooling the image with the temperature-sensitive ink.

* * * * *